United States Patent [19]

Ragland

[11] Patent Number: 4,471,593

[45] Date of Patent: Sep. 18, 1984

[54] FASTENING CLIP FOR PANEL

[76] Inventor: Douglas Ragland, P.O. Box 55527, Houston, Tex. 77055

[21] Appl. No.: 20,756

[22] Filed: Mar. 15, 1979

[51] Int. Cl.[3] ..... E04B 5/52

[52] U.S. Cl. ..... 52/489; 52/509; 52/714

[58] Field of Search ..... 52/489, 361–363, 52/714, 509, 511; 24/73 B, 73 PC

[56] References Cited

U.S. PATENT DOCUMENTS 3,922,764 12/1975 Downing ..... 52/489

3,934,387 1/1976 Moeller ..... 52/489

*Primary Examiner*—James L. Ridgill, Jr.

*Attorney, Agent, or Firm*—Browning, Bushman, Zamecki & Anderson

[57] ABSTRACT

A fastening clip for securing a wall panel or the like to a suitable supporting structure, such as a stud having flanges parallel to and supporting the panel, the fastening clip being constructed such that it will provide a strong support for holding the panel firmly against the support with a force greater than that which the clip in normal flexure would permit, yet be readily flexible with a much less force to permit the panel to be put in place. The clip is further constructed such that a panel, which cannot readily be moved laterally to any great degree to engage the clip with the support, may be engaged with the support by moving the edge of the panel directly toward the support, in a direction substantially normal to the facing surfaces of the panel and support.

6 Claims, 5 Drawing Figures

FIG. 1
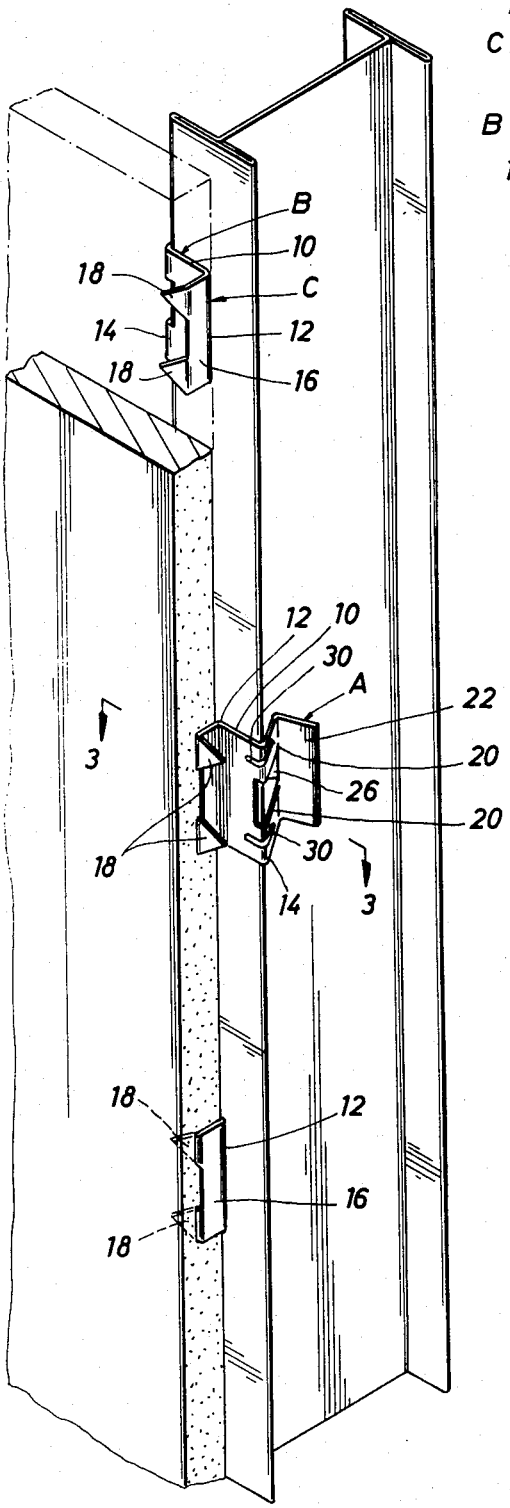
FIG. 2
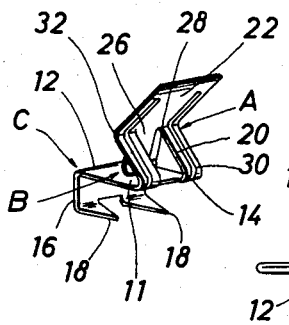
FIG. 3
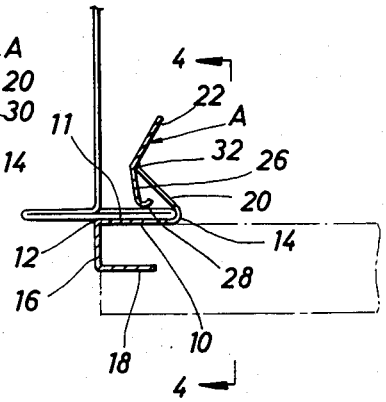
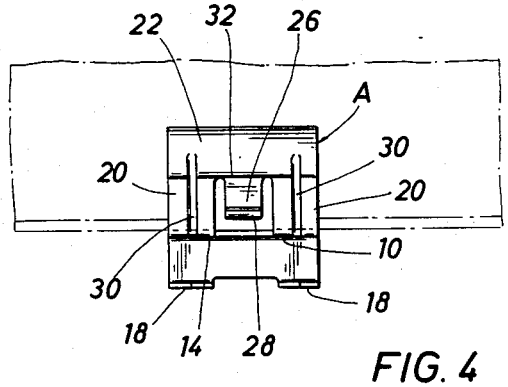
FIG. 4
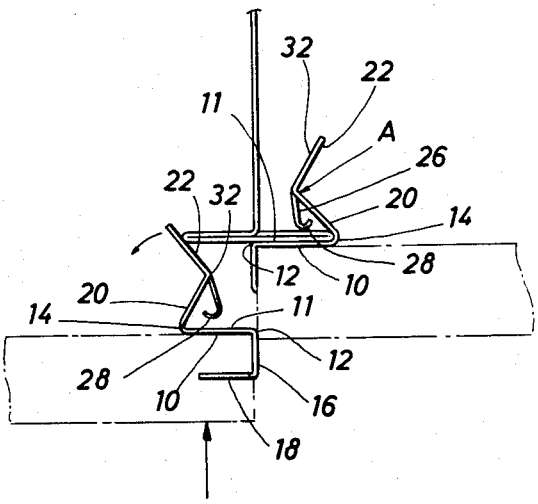
FIG. 5

FASTENING CLIP FOR PANEL

BACKGROUND OF THE INVENTION

The present invention relates to wall construction, and, more particularly, to a form of dry wall construction in which wall panels are removably secured to a supporting structural framework comprised of studs or the like, particularly fabricated studs with flanges parallel to and supporting the back faces of the panels, by means of fastening clips. More particularly, the present invention relates to an improved form of fastening clip.

It is extremely desirable, particularly in commercial building construction, to provide building partitions and walls and systems for assembling such partitions and walls in which the entire partition or wall may be easily removed or in which individual panel members making up the partition or wall can be removed, rearranged, or replaced with doors, windows, or other openings or units. Numerous systems and wall construction methods have been proposed for accomplishing this result. Many of the systems proposed rely on the use of specially constructed panels which permit them to be removably disposed on the supporting structure and/or utilize supporting structures, e.g. studs, which are necessarily of special design and hence expensive to manufacture.

Typical of demountable dry wall construction systems which use fastening clips to removably secure panels to wall studs is the system shown in U.S. Pat. No. 3,922,764 to Downing, Jr.

The fastening clips used in the system disclosed in the Downing patent, as well as fastening clips used in other prior art systems have suffered from the disadvantage that, if the wall panel is warped or bowed, a flush joining between abutting panels is difficult to achieve. Additionally, most prior art fastening clips which employ resilient gripping of the support member by the clip suffer from the disadvantage, not only that the clip can easily slip off of the support member, but that it is held to the support member with an easily yieldable resilient finger and may permit the panel to be flexed away from the support member, even though the clip may not be disengaged from the support member. This is particularly true in the cases where the wall panel is warped and hence the fastening clip is subjected to higher than normal disengagement force. Nevertheless, such types of clip have been considered necessary in order to make the clip easily engageable with the support either in lateral movement toward the support or in movement directly toward the support at substantial right angles to the face of the panel.

SUMMARY OF THE INVENTION

It is therefore an object of the present invention to provide an improvement in a fastening clip for securing a wall panel to a support member.

Still a further object of the present invention is to provide a fastening clip for securing a wall panel to a support member wherein the fastening clip is provided with means for insuring that the wall panels are not readily flexed away from the support member by a force no greater than that required initially to engage the clip with the support member, but rather to sustain the wall panel against movement away from the support by a force even substantially greater than that necessary initially to engage the clip with the support.

Still a further object of the present invention is to provide a fastening clip for securing a wall panel to a support member wherein the fastening clip is provided with means for insuring that the wall panels are not readily flexed away from the support member by a force less than one which would distort the clips to the extent of practical destruction.

A further object of the present invention is to provide an improved fastening clip for securing a wall panel to a support member which is flexible to permit engagement with a flange of a support member by movement directly toward the face of the flange, to make possible the mounting of a final closure of access panel without lateral movement of the panel relative to the support member, and then to snap into engagement with the flange, yet which, once engaged will hold the panel substantially rigidly against the support member.

Another object is to provide such a clip as last above described which will cooperate with conventional metal studs having thin flanges to receive the panels.

The above and other objects of the present invention will become apparent from the drawings, the following description and the appended claims, wherein is set forth specifically by way of example a preferred embodiment of the invention.

In accordance with the above stated objects, the present invention provides a fastening clip for securing a panel having a side edge to a support member. The fastening clip is comprised of a base portion having front and back sides and first and second edges. A leg portion depends from the first edge in a direction generally outwardly from the front side of the base portion, the leg portion including retaining means in the form of progns which are forced into the side edge of the panel to thereby secure the clip to the panel. A gripping structure is disposed adjacent the back side of the base portion and is connected to the second edge of the base portion, preferably by a ribbed web or webs, the gripping structure being resiliently moveable generally laterally of the back side whereby a portion, e.g. a flange, of a support member may be gripped between the back side of the base member and a gripping finger on the gripping structure extending directly toward and substantially normal to the backside of the base portion, to thereby act as a strut to secure the panel to the support member.

There is further provided by the present invention a wall construction comprising a wall panel having a marginal side edge, suitable support structure such as provided by conventional studs of I-shaped cross-section, and the above described fastening clips for securing the panel to the support structure.

BRIEF DESCRIPTION OF THE DRAWINGS

FIG. 1 is a perspective view of a stud and clips holding a wall panel thereon in accordance with this invention.

FIG. 2 is a perspective view of a fastening clip according to the present invention.

FIG. 3 is a sectional view along the line 3—3 of FIG. 1 showing how the fastening clip shown in FIG. 1 engages both the stud flange and the panel.

FIG. 4 is a sectional view of the wall construction according to the present invention, taken along the line 4—4 of FIG. 3.

FIG. 5 is a view similar to FIG. 3, but showing additionally the manner in which a panel may be installed in accordance with this invention without lateral movement relative to the stud.

DESCRIPTION OF THE PREFERRED EMBODIMENT

Referring first to FIG. 2, the fastening clip C of the present invention comprises a base portion, generally indicated at B, having a front side 10, a back side 11, a first edge 12, and a second edge 14. A leg portion 16 depends from the first edge 12 in a direction generally away or outwardly from the front side 10. Formed on leg portion 16 are a pair of prongs 18 extending generally parallel to the front side 10 toward the second edge 14. While the fastening clip is provided with two prongs 18 as shown, it will be understood that either a single, generally centrally disposed prong depending from leg 16 or a larger plurality of prongs will work satisfactorily. As will be seen hereafter, prongs 18 serve as retaining means to secure clip C to the marginal edge of a wall panel.

Clip C is also provided with a gripping finger 26 disposed generally adjacent the back side 11 of base B. Gripping finger 26, which extends toward the back side 11 of base portion B at substantially a right angle thereto, or normal thereto, is carried by the mid-portion of an anggle of the gripping finger support structure A. Support structure A is comprised of a part made up of two spaced legs 20, conveniently in one plane, extending at an acute angle rearwardly from the second edge 14 of the base portion B to a position spaced from but overlying an intermediate part of the back side of the base portion. These two legs are, at such position, joined together to form a unitary flange or leg 22 of the support structure A, which, in turn, extends from such position, also at an acute angle rearwardly from the base portion B. However, flange or leg 22 is angled in the opposite direction from the legs 20 relative to the base portion, so that its free edge at its extremity extends rearwardly slightly past a position directly overlying the second or back edge 14 of the base portion.

The position of joinder of the legs 20 and 22 provides a gripping finger support and the gripping finger 26 is carried by the gripping finger support at approximately the juncture of these two legs 20 and 22. Thence it extends directly toward the back side of the base portion in a disposition substantially normal or at a right angle to the plane of such base portion. Thus, when a flange of a stud or the like, of a thickness slightly greater than the distance between the free end of the gripping finger 26 and the backside of the base portion, is positioned between such free end and back side, the finger 26, acting in compression and as a strut, will exert a clamping force on such flange. So acting, it can exert much greater clamping force than if it were exerting its force laterally in a direction tending to flex the finger. However, in order to prevent the otherwise sharp edge of the finger engaging the flange from digging into the flange as it moves into gripping position, and hence not be movable readily into its ultimate desired gripping position as shwon, this edge is preferably rolled as at 28, to provide it with a rounded exterior surface that will slip readily along the back surface of the flange of the support member.

The gripping finger 26, being joined to the gripping finger support structure A at the position where the legs 20 and 22 are joined as indicated by the numeral 30, is enabled to exert the clamping force above mentioned by virture of the strong support provided by such supporting structure. In order to make such support of ample strength, not only are the legs 20 taken together about twice the width of the finger 26, and hence more resistant to flexing, but they are additionally stiffened against flexure by ribs 30. Thus, their combined strength, in flexure, may be designed to be comparable to that of the finger 26 acting as a strut. The ribs 30 not only extend the length of the legs 20, but also past the joinder of the legs 20 to the base portion, as shown clearly in the middle part of FIG. 1, and in the opposite direction past the gripping finger support position 32 along part of the extent of the leg 22, as shown clearly in FIGS. 2 and 4. Thus the support point or position 32 to which one end of the support finger 26 is joined, is a relatively rigidly positioned support position at a substantially fixed direction from and opposite an intermediate portion of the back side of the base portion B.

It will be clear from the foregoing that, with the gripping finger 26 made of such extent as to leave slightly less than the thickness of the flange of the support between its rolled extremity 28 and the rear face of the base portion, it will act as a strut in gripping the flange of the support so firmly that a panel secured thereby to the support may not be moved away from the support without exertion of a force much greater than that which would be necessary to flex the gripping finger laterally. Furthermore, if it should be moved away from the support by an excessive force, the gripping finger itself will be distorted to a point that it will need to be replaced for use. However, it is still possible to remove the panel in such fashion and then to replace it by the use of a new clip.

Notwithstanding the face that the finger 26 is so strongly supported at a substantially fixed distance from the rear face of the base portion B, the resilient lateral flexibility with which the finger 26 is designed will permit it to flex laterally, when slipping laterally with respect to the edge of the panel and with respect to the edge of the flange of the support, so as to relieve its gripping force against the flange with relatively small effort and permit it to slide laterally over the flange into its desired position. The rounding provided by the rolled edge 28 will facilitate such sliding movement. The inherently resilient nature of the gripping finger 26 will cause it, once the clip is in desired position relative to the flange of the support, to tend to move to its desired substantially normal position relative to the rear face of the flange and thus to exert its maximum gripping force against the flange.

While the gripping finger support structure provided by the legs 20 and 22 and the ribs 30 make them into a relatively rigid structure rather difficulty flexible relative to the base portion, the application of a substantial amount of force may still flex the base portion adjacent to the legs 20 sufficiently to permit the gripping finger support structure to slip past the edge of a flange on a support and permit the gripping finger 26 to snap into engagement with the rear face of such flange. This is facilitated by the provision of the leg 22 which, when the edge of the support panel to be engaged against a support flange bears such clip, will be the first part of the clip to engage the edge of the flange. Then upon the exertion of a substantial force pushing the edge of the panel and the clip against the flange, as perhaps by a sharp blow of a hammer or the like for such purpose, will cause the angled position of the face of the leg 22 to wedge the gripping finger support structure laterally and enable it to slip past the flange.

From the foregoing it will be seen that a clip has been provided which, when attached to the edge of a panel to be secured to the face of a flange of a support, may be moved laterally toward the edge of such flange with the face of the flange in engagement with the rear face of the base portion B of the clip. The gripping finger will be flexed laterally by this step to move the rolled end portion slightly away from the rear face of the flange and relieve the gripping force against the flange so as to permit the panel to be readily slipped laterally with respect to the support until the clip is in full engagement with the flange. Then the inate resiliency of the gripping finger will cause it to slip along the face of the flange slightly further until it will exert its maximum gripping force against the flange and prevent the panel from being moved outwardly away from the flange.

On the other hand, if the panel B is in such position in the wall that it may not be readily moved laterally relative to the support but must be moved directly toward the support at substantially right angles to the face of the flange and panel in putting it in place, the leg 22 of the clip will engage the edge of the flange of the support and force the gripping finger support structure 20, 22, 32 laterally relative to the base portion of the clip until such support structure will permit the passage of the edge of the flange past the support structure to engage the base portion B. Thereupon the gripping finger will snap into position in engagement with the rear face of the flange to secure the panel in place. This will, of course, require a very substantial force such as will be provided by a sharp blow from a hammer or the like but will enable the panel to be quickly and rigidly installed without substantial lateral movement relative to the support and then to be held rigidly against the support to prevent it from being bulged away by warpage or the like.

The invention may be embodied in other specific forms without departing from the spirit or essential characteristics thereof as defined in the appended claims. The present embodiment is therefore to be considered, in all respects, as illustrative and not restrictive, the scope of the invention being indicated by the appended claims rather than by the foregoing description, and all changes which come within the meaning and range of equivalence of the claims are therefore intended to be embraced therein.

I claim:

1. A fastening clip for securing a wall panel or the like having a side edge to a support member having a flange to receive and support such side edge of the panel in parallel relation to the faces of the flange and the panel, said clip comprising:

a base portion having a front side, a back side, a first edge, and a second edge, a leg portion extending from said first edge in a direction generally outwardly from said front side, said leg portion including retaining means to secure said clip to said side edge of the panel, substantially rigid gripping finger support means substantially rigidly joined to said second edge of the base portion and providing a gripping finger support for a part of a gripping finger at a position overlying and spaced from said back side of the base portion intermediate its edge and relatively fixed with respect to said back side, and a laterally flexible gripping finger having one end disposed adjacent the back side of said base portion and extending therefrom substantially normal to said back side and rigidly secured to said gripping finger support, whereby said support member flange may be gripped between said back side of said base member and the end of said gripping finger which is closer to said base member, the gripping force being transmitted by said finger acting as a strut, longitudinally of itself, so as to be not limited to the force necessary to flex said finger laterally, said gripping finger support means having an extension substantially rigidly joined thereto adjacent said gripping finger support and extending at an acute angle to the plane of said base portion, in a direction away from said base portion and at least to a position overlying said second edge of the base portion, whereby a panel edge having such clip thereon may be moved directly toward such support without lateral movement relative thereto and said inclined extension will engage and deflect said gripping finger support means past the support flange and permit the gripping finger to snap into place behind said flange.

2. The clip of claim 1 in which the material of said base portion, the material of said gripping finger support means, and the extension of said gripping finger support means, have a form reinforcing the relative rigidity of their joinder to one another.

3. The clip of claim 1 in which said gripping finger is laterally resiliently flexible toward and away from said second edge of the base portion to relieve the gripping force exerted by it against said flange and facilitate sliding of said clip onto and off said flange.

4. The clip of claim 3 in which the extremity of said finger closer to the base portion is smoothed to permit it to move with reduced friction laterally along the rear surface of said flange to a position where it will sustain the greatest gripping force on said flange and best hold said flange against said support.

5. The clip of claim 4 in which the smoothed extremity of said finger is a rounded exterior end portion.

6. The clip of claim 4 in which the smoothed extremity of said finger is a rolled portion of the end of the finger.

* * * * *